US006850215B2

(12) United States Patent
Lee et al.

(10) Patent No.: US 6,850,215 B2
(45) Date of Patent: Feb. 1, 2005

(54) METHOD FOR IMPROVING GRADATION OF IMAGE, AND IMAGE DISPLAY APPARATUS FOR PERFORMING THE METHOD

(75) Inventors: Seong-deok Lee, Kyungki-do (KR); Chang-yeong Kim, Kyungki-do (KR); Yong-sik Moon, Kyungki-do (KR)

(73) Assignees: Samsung Electronics Co., Ltd., Suwon-Si (KR); Samsung Electro-Mechanics Co., Ltd., Suwon-Si (KR)

( * ) Notice: Subject to any disclaimer, the term of this patent is extended or adjusted under 35 U.S.C. 154(b) by 305 days.

(21) Appl. No.: 10/259,628

(22) Filed: Sep. 30, 2002

(65) Prior Publication Data

US 2003/0132905 A1 Jul. 17, 2003

(30) Foreign Application Priority Data

Oct. 31, 2001 (KR) ..... 2001-67625

(51) Int. Cl.[7] ..... G09G 3/36
(52) U.S. Cl. ..... 345/89; 345/87; 345/690
(58) Field of Search ..... 345/63, 77, 84, 345/87, 89, 214, 690

(56) References Cited

U.S. PATENT DOCUMENTS

| | | | | |
|---|---|---|---|---|
| 3,937,878 A | | 2/1976 | Judice | |
| 4,082,430 A | * | 4/1978 | Schulthess et al. | 345/87 |
| 4,921,334 A | | 5/1990 | Akodes | |
| 5,162,925 A | | 11/1992 | Takaoka et al. | |
| 5,465,168 A | * | 11/1995 | Koden et al. | 349/33 |
| 5,748,275 A | * | 5/1998 | Sato et al. | 349/144 |
| 5,953,002 A | * | 9/1999 | Hirai et al. | 345/204 |
| 6,020,870 A | * | 2/2000 | Takahashi et al. | 345/92 |
| 6,177,915 B1 | * | 1/2001 | Beeteson et al. | 345/87 |

OTHER PUBLICATIONS

Pfieffer, M., *Liquid Crystals for LCoS*, Society for Information Display, Seminar Lecture Notes, vol. 1, May 2000, Seminar M–13, pp. 1–3.

* cited by examiner

*Primary Examiner*—Amare Mengistu
*Assistant Examiner*—Tom Sheng
(74) *Attorney, Agent, or Firm*—Burns, Doane, Swecker & Mathis, L.L.P.

(57) ABSTRACT

Provided are a method of improving the gradation of an image, and an image display apparatus for performing the method. The method is to improves gradations of an image carried out by a liquid crystal display including a liquid crystal driving unit for generating a liquid crystal driving signal in response to voltage, which is selected in accordance with the size of an image signal from liquid crystal driving voltages each classified by first and second fields which constitutes a unit frame, and a liquid crystal display panel for being driven in response to the liquid crystal driving signal and displaying the image, the method includes (a) measuring luminance levels of an image displayed on the liquid crystal display panel while changing the liquid crystal driving voltage per frame; (b) determining at least one luminance level section whose gradations needs to be improved from the measured luminance levels; (c) producing new liquid crystal driving voltages to be increased or decreased centering around the liquid crystal driving voltage related to lowest luminance level per the first and second fields in each determined luminance level section; (d) obtaining new luminance levels using the produced new liquid crystal driving voltages; (e) selecting at least one available first luminance level from the new luminance levels; and (f) checking whether the gradations of the image are improved using the first luminance level, and/or returning back to step (e) if the gradations are not improved. According to this method, it is possible to increase the number of gradations of an image and make irregular difference between luminance levels of gradations regular, thereby improving the quality of the image.

17 Claims, 4 Drawing Sheets

METHOD FOR IMPROVING GRADATION OF IMAGE, AND IMAGE DISPLAY APPARATUS FOR PERFORMING THE METHOD

CROSS-REFERENCE TO RELATED APPLICATIONS

This application is based upon and claims priority from Korean Patent Application No. 2001-67625 filed Oct. 31, 2001, the contents of which are incorporated herein by reference.

BACKGROUND OF THE INVENTION

1. Field of the Invention

The present invention relates to an image display apparatus such as a monitor or a television, and more particularly, to a method of improving the gradation of an image and an image display apparatus for performing the method.

2. Description of the Related Art

The gradation of an image in the image display apparatus is one of the factors that determine the quality of the image. Unlike a cathode-ray tube (CRT) adopting an electron gun, the performance of a general liquid crystal display (LCD) or liquid-crystal-on-silicon (LCoS) display, which uses liquid crystal, may abruptly change according to the physical characteristics of the crystal used or a method of driving the liquid crystal. Here, the performance is related to the factor with which is transmitted to or reflected from a liquid crystal display panel according to liquid crystal driving voltage. As a result, a general LCD is not capable of appropriately displaying an image having more than a predetermined number of gradations, e.g., 8-bit ($2^8$) gradations, on each of R, G, and B channels (here R, G, and B denote 'red', 'green' and 'blue, respectively). Even if the 8-bit gradations are all displayed, an irregular difference in the luminance levels of the gradations cannot be removed. Therefore, in a general LCD, when the number of gradations is insufficient or a difference between luminance levels among gradations of the image is irregular, rough gradation borders are prone to occur at an image of a face at which gradations change gradually.

Hereinafter, conventional methods of improving the gradation of an image will be described.

First, when the number of gradations displayed is insufficient, the number of insufficient gradations is increased spatially or using time division. In particular, a half-toning method is commonly used to increase the number of gradation spatially. The half-toning method is subdivided into a dithering method of displaying medium gradations using pixels of predetermined area, e.g., 3×3, and an error diffusion method of comparing an input value of each pixel with values capable of being output and then diffusing a difference between an input value and the output value, i.e., an error value, to neighboring pixels. Here, one of dithering methods is disclosed in U.S. Pat. No. 3,937,878 entitled "Animated Dithered Display Systems". In the disclosed dithering method, gradations are displayed with an area mask, and thus, regions of an image having high frequency components are difficult to be displayed, i.e. the resolution of an image may deteriorate. One of error diffusion methods is disclosed in U.S. Pat. No. 5,162,925 entitled "Color Image Processor Capable of Performing Masking Using a Reduced Number of Bits". The disclosed error diffusion method overcomes deterioration of the resolution of an image caused by the dithering method, but additionally requires a frame memory of predetermined size to calculate diffused errors, thereby making the structure of a system complex and voluminous. Further, the disclosed error diffusion method generates peculiar patterns at the edge of an image or a color-flattened region.

A method of controlling frame-rate is a typical method of increasing the number of insufficient gradations using time division. In this method, a unit image frame is divided into sub-frames having different periods of emitting light, e.g., eight sub-frames, on a time axis, and then, these sub-frames are combined to display the gradations of an image. This method is capable of preventing the generation of peculiar patterns when increasing the number of gradation spatially, but may deteriorate the luminance efficiency and cause false contour problems.

Meanwhile, there is another conventional method of improving the gradation of an image, disclosed in U.S. Pat. No. 4,921,334 entitled "Matrix Liquid Crystal Display with Extended Gray Scale". The disclosed method produces new medium gradations by switching neighboring liquid crystal driving voltages. However, this method is disadvantageous in that the number of gradations cannot be increased more than two times.

There is also a conventional spatial-temporal dithering method of improving the gradation of an image, disclosed in *Three-Five systems* (SID 2000 Seminar lecture notes, volume 1, M-13). This method combines a spatial dithering method using a 2×2 pixel mask, and a temporal dithering method using two different voltage levels adjacent to two sub-fields, and produces three additional gradations. This method is advantageous in that a lot of new gradations can be produced, but the resolution of an output image may deteriorate due to the use of a spatial dithering method. Also, this method generates the aforementioned peculiar patterns at the edge of an image or color-flattened region, and further requires additional circuits to perform this method.

In the event that a difference between the luminance levels of gradations is irregular, it is difficult to make the irregular difference regular by the above-mentioned conventional methods of improving the gradation of an image. As a result, the number of the gradations may decrease more and more.

SUMMARY OF THE INVENTION

To solve the above problems, it is a first object of the present invention to provide a method of improving the gradation of an image, by which the number of gradations is increased using liquid crystal driving voltages that are produced to have different levels per field, and furthermore, a difference between luminance levels of gradations is made regular.

It is a second object of the present invention to provide an image display apparatus for performing such a method of improving the gradation of an image.

To achieve the first object, there is provided a method of improving gradations of an image carried out by a liquid crystal display including a liquid crystal driving unit for generating a liquid crystal driving signal in response to voltage, which is selected in accordance with the size of an image signal from liquid crystal driving voltages each classified by first and second fields which constitutes a unit frame, and a liquid crystal display panel for being driven in response to the liquid crystal driving signal and displaying the image. The method includes (a) measuring luminance levels of an image displayed on the liquid crystal display panel while changing the liquid crystal driving voltage per frame; (b) determining at least one luminance level section whose gradations needs to be improved from the measured luminance levels; (c) producing new liquid crystal driving voltages to be increased or decreased centering around the liquid crystal driving voltage related to lowest luminance level per the first and second fields in each determined luminance level section; (d) obtaining new luminance levels using the produced new liquid crystal driving voltages; (e) selecting at least one available first luminance level from the new luminance levels; and (f) checking whether the gradations of the image are improved using the first luminance level, and/or returning back to step (e) if the gradations are not improved.

To achieve the second object, there is provided a liquid crystal display for performing such a method of improving gradations of an image, the liquid crystal display including a first storage unit for reading out voltage corresponding to the size of the image signal from the liquid crystal driving voltages stored with respect to the first field, in response to a first control signal; a second storage unit for reading out voltage corresponding to the size of the image signal from the liquid crystal driving voltages stored with respect to the second field, in response to a second control signal; a liquid crystal driving unit for generating a liquid crystal driving signal in response to the liquid crystal driving voltage read out by the first or second storage unit; a liquid crystal driving voltage generator for measuring the luminance levels of the image displayed on the liquid crystal display panel, and for generating the new liquid crystal driving voltages classified by the first and second fields in each luminance level section extracted from the measured luminance levels; and a controller for alternately generating one of the first and second control signals in the unit of field, selecting at least available first luminance level from the new luminance levels, checking whether gradations of the image is improved based on the selected first luminance level, and again selecting the first luminance level in response to the checked result, wherein the first and second storage units updates the stored liquid crystal driving voltage with the new liquid crystal driving voltage generated by the liquid crystal driving voltage generator.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

A method of improving the gradation of an image, and the structure and operation of an image display apparatus capable of performing the method, according to the present invention, will now be described with reference to the accompanying drawings.

Figure 1:
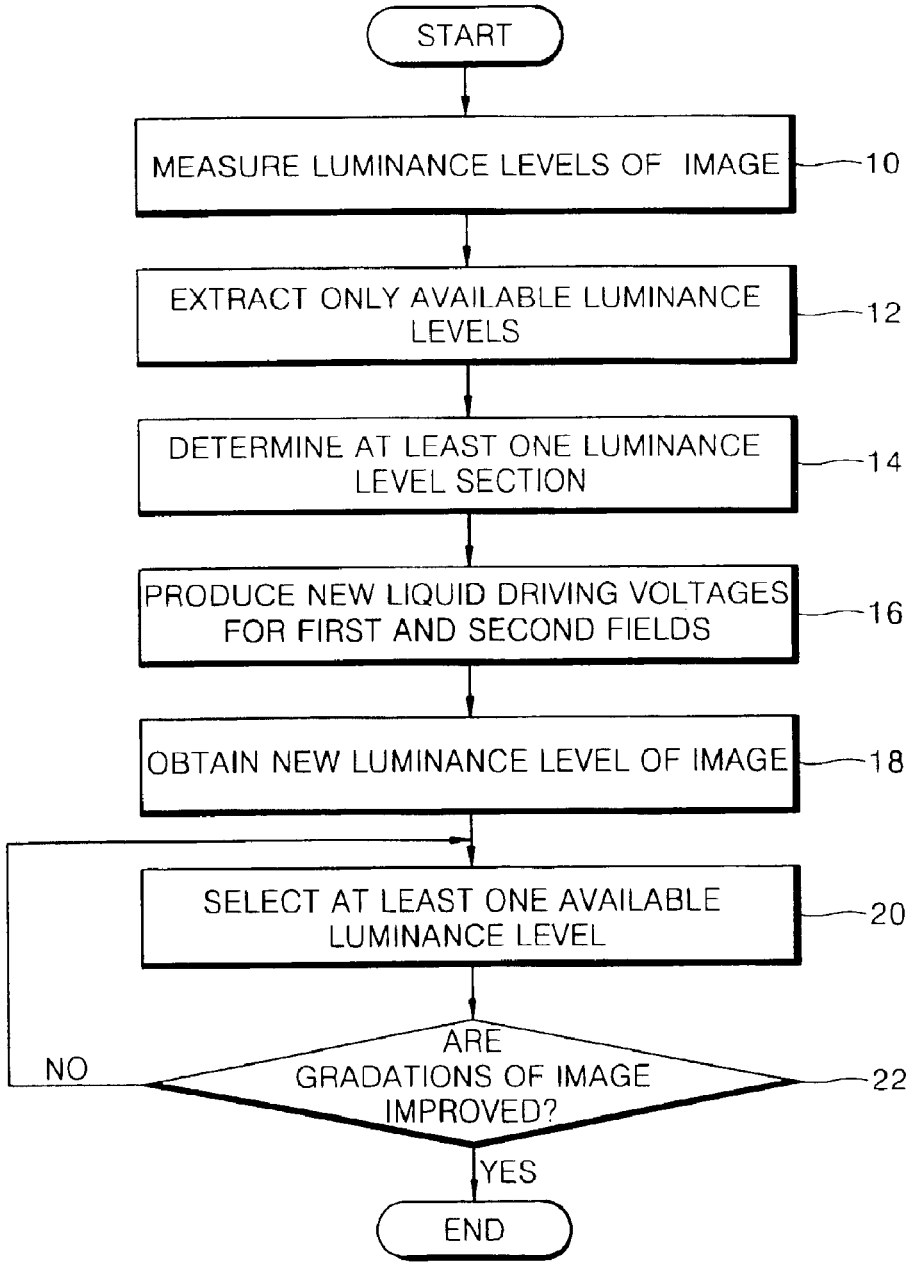
FIG. 1 is a flow chart for explaining a method of improving the gradation of an image according to a preferred embodiment of the present invention.

FIG. 1 is a flow chart for explaining a method of improving the gradation of an image according to a preferred embodiment of the present invention. In the method, luminance levels of an image are measured and extracted (steps 10 and 12). Next, new liquid crystal driving voltages are divided into fields (steps 14 and 16). Then, available first luminance levels are selected among the new luminance levels of an image generated by new liquid crystal driving voltages until the gradations of the image are improved (steps 18 through 22).

Figure 2:
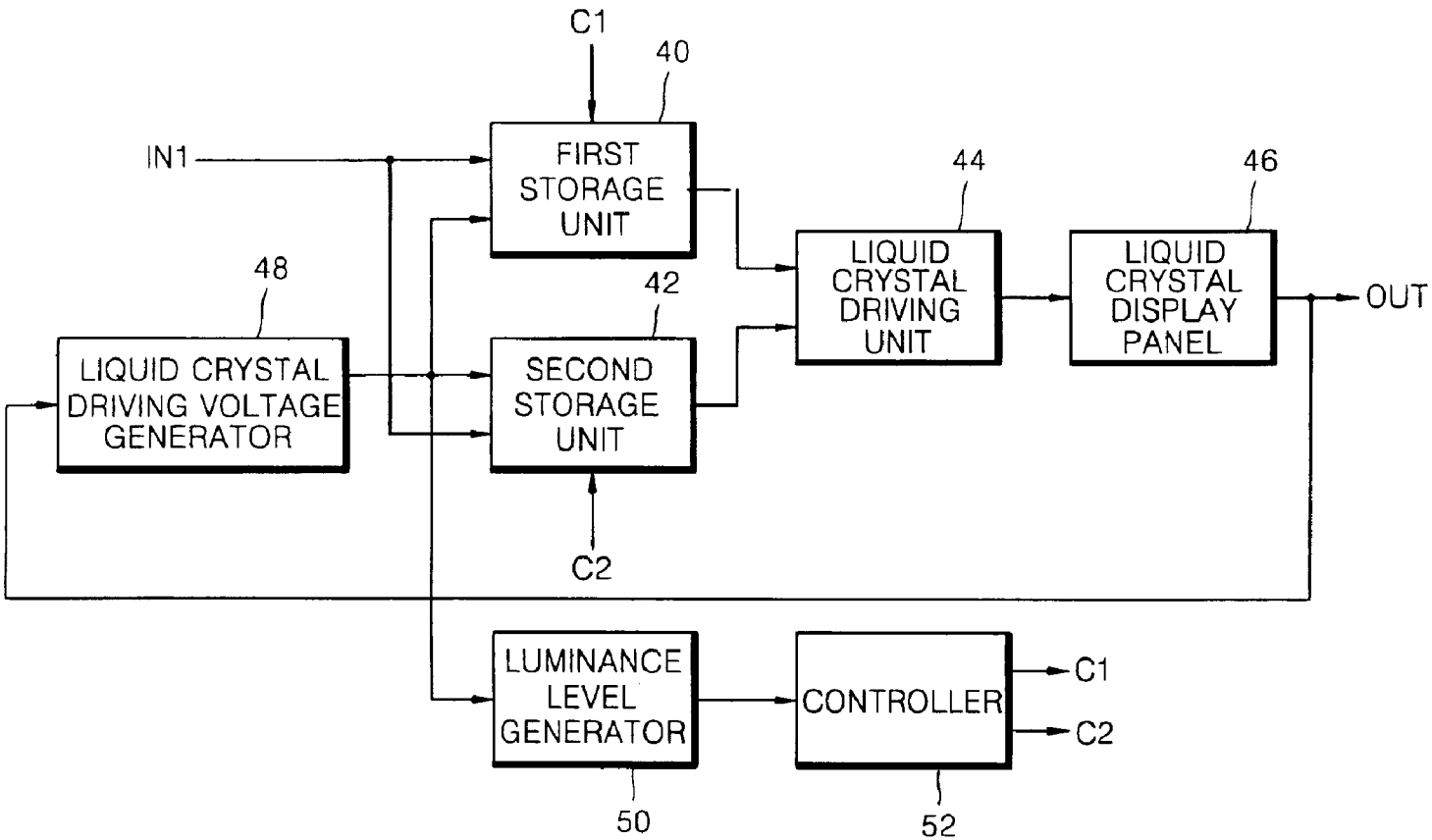
FIG. 2 is a block diagram of an image display apparatus, according to a preferred embodiment of the present invention, for performing the method of FIG. 1.

FIG. 2 is a block diagram of an image display apparatus, according to the present invention, which carries out the method of FIG. 1. The image display apparatus includes first and second storage units 40 and 42, a liquid crystal driving unit 44, a liquid crystal display panel 46, a liquid crystal driving voltage generator 48, a luminance level calculator 50, and a controller 52.

In a method for improving the gradation of an image according to a preferred embodiment of the present invention, in step 10, luminance levels of the image displayed on the liquid crystal display panel 46 are measured while changing per frame the liquid crystal driving voltages which are divided into first and second fields that constitute unit frames of the image, and then, a measurement table that shows the relationship between measured luminance levels and the liquid crystal driving voltages, is produced.

According to this embodiment, the first and second storage units 40 and 42, the liquid crystal driving unit 44, the liquid crystal display panel 46, the liquid crystal driving voltage generator 48 and the controller 52 may perform step 10. Here, the first and second storage units 40 and 42 store in advance the liquid crystal driving voltages that change per frame and have the same level in the two fields of each frame. The liquid crystal driving voltages stored in the first and second storage units 40 and 42 are alternately read out per field in response to first and second control signals C1 and C2 generated by the controller 52. For the read operation of the first and second storage units 40 and 42, it is possible to realize the first and second storage units 40 and 42 as look-up tables or the like. For instance, the first storage unit 40 selectively reads voltage, which corresponds to the size of an image signal input through an input terminal IN1, from liquid crystal driving voltages stored in the first field in response to the first control signal C1 input from the controller 52. Also, the second storage unit 42 selectively reads voltage, which corresponds to the size of an image input through the input terminal IN1, from liquid crystal driving voltages stored in the second field in response to the second control signal C2 input from the controller 52. Here, the controller 52 alternately generates one of the first and second control signals C1 and C2 in the unit of a field, and outputs the same to the first and second storage units 40 and 42.

Figure 3:
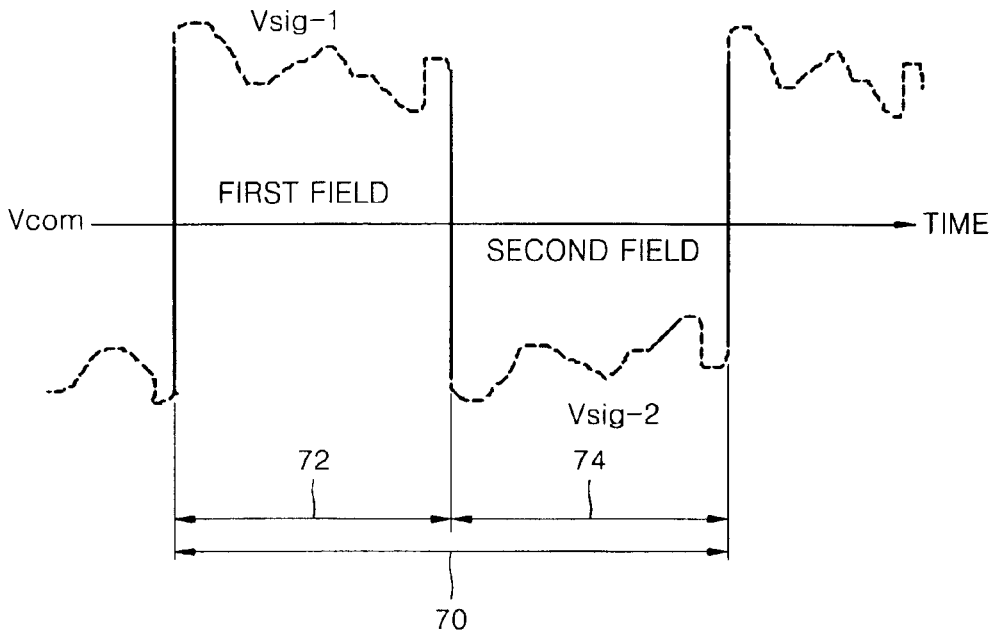
FIG. 3 is a waveform diagram illustrating a liquid crystal driving signal.

FIG. 3 is a waveform diagram illustrating a liquid crystal driving signal. Here, the x-axis and y-axis denote time and the amplitude of the liquid crystal driving signal, respectively.

The liquid crystal driving unit 44 of FIG. 2 generates a liquid crystal driving signal illustrated in FIG. 3 in response to liquid crystal driving voltage read out selectively by the first or second storage unit 40 or 42, and further outputs the generated liquid crystal driving signal to the liquid crystal display panel 46. Here, when the liquid crystal is driven by alternate current (AC), a unit frame 70 of the liquid crystal driving signal of FIG. 3 is made of first and second fields that are symmetrical with each other with regard to a center voltage Vcom. In other words, as shown in FIG. 3, the liquid crystal driving signal is made of a liquid crystal driving signal for the first field, i.e., Vsig-1, and a liquid crystal driving signal for the second field, i.e., Vsig-2.

For instance, assuming that the first and second storage units 40 and 42 are look-up tables LUT-1 and LUT-2, the number or index of different sizes an image signal input through the input port IN1 can have is $2^8$, i.e., 256, and the center voltage is 407, liquid crystal driving voltage values of three RGB channels, which are stored in the first and second storage units 40 and 42, are selectively output to the liquid crystal driving unit 44 to correspond to the size of an image signal input through the input terminal IN1, as in the following Table 1:

TABLE 1

| | LUT-1 | | | LUT-2 | | |
|---|---|---|---|---|---|---|
| Index | R | G | B | R | G | B |
| 0 | 753 | 753 | 753 | 61 | 61 | 61 |
| 1 | 752 | 752 | 752 | 62 | 62 | 62 |
| 2 | 751 | 751 | 751 | 63 | 63 | 63 |
| 3 | 750 | 750 | 750 | 64 | 64 | 64 |
| 4 | 749 | 749 | 749 | 65 | 65 | 65 |
| . | . | . | . | . | . | . |
| . | . | . | . | . | . | . |
| . | . | . | . | . | . | . |
| 253 | 499 | 499 | 499 | 315 | 315 | 315 |
| 254 | 498 | 498 | 498 | 316 | 316 | 316 |
| 255 | 497 | 497 | 497 | 317 | 317 | 317 |

At this time, the liquid crystal display panel 46 displays an image via an output terminal OUT with being driven in response to a liquid crystal driving signal input from the liquid crystal driving unit 44. The liquid crystal driving voltage generator 48 measures the luminance levels of images displayed on the liquid crystal display panel 46. For example, the liquid crystal driving voltage generator 48 may be a colorimeter or spectroradiometer.

After performing step 10, a difference between luminance levels of adjacent gradations from the measured luminance levels is used to extract available second luminance levels (step 12). Luminance levels (y_a and y_b) of adjacent gradations satisfying the following equation are determined as the second luminance levels:

$$\frac{|y_a - y_b|}{y_a} > y_delta \tag{1}$$

wherein y_delta corresponds to T/A, where A denotes the number of different luminance levels of the pixel of an image, which is displayed on the liquid crystal display panel 46 and can have, e.g., $2^n$, and T denotes an allowable tolerance factor that is within a range of $0–2^n$, and is smaller than 1, and is ideally, 1. The more irregular is difference between luminance levels of gradations, the more T closely approximates 0, thereby reducing the number of the gradations.

To perform step 12, the liquid crystal driving voltage generator 48 extracts available second luminance levels using a difference between luminance levels of adjacent gradations from the measured luminance levels.

After step 12, at least one luminance level section whose gradations needs to be improved is selected out of the extracted second luminance levels using equation 1 (step 14).

Figure 4:
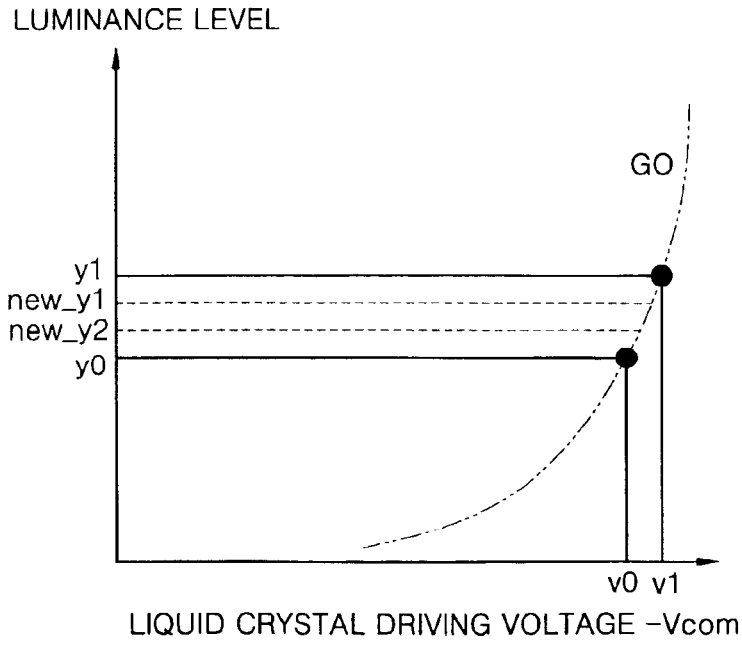
FIG. 4 is a graph showing the relationship between a liquid crystal driving voltage and luminance level.

FIG. 4 is a graph illustrating the relationship between liquid crystal driving voltage and a luminance level. Here, the x-axis of the graph indicates a difference value between the liquid crystal driving voltage and the reference voltage Vcom, i.e., AC components of the liquid crystal driving voltage, and the y-axis indicates the luminance level of an image displayed on the liquid crystal display panel 46.

Referring to FIG. 4, in the even that a change y1–y0 in the luminance levels of images displayed on the liquid crystal display panel 46 to a change v1–v0 in the liquid crystal driving voltages is very larger, that is, the slope is steep, a luminance level section having the steep slope is determined to be a section whose gradation requires to be improved According to this embodiment, step 14 may be performed in the liquid crystal driving voltage generator 48. That is, the liquid crystal driving voltage generator 48 determines a luminance level section among the extracted second luminance levels.

Meanwhile, step 12 can be omitted in a method for improving gradation of an image according to another embodiment of the present invention. In this case, at least one luminance level section is determined out of the measured luminance levels after step 10 (step 14).

If the number of gradations expressed is insufficient and thus needs to be increased, step 12 may not be included in the method illustrated in FIG. 1 for improving gradations of an image. However, step 12 must be performed in the method illustrated in FIG. 1 for improving gradations of image if a difference between the luminance levels of gradation must be regular when a difference between the luminance levels of gradations is irregular, and T approximates 0.

In the method according to a preferred embodiment of the present invention, when determining the luminance level selection the liquid crystal driving voltage generator 48 determines the number of gradations in each luminance level section determined (step 14). If step 12 is included in this method, i.e., there is a need to overcome an irregular difference between luminance levels, a measurement table is compared with a reference table, and measures the number of gradations using the compared result. Here, the reference table is a table where liquid crystal driving voltages and reference luminance levels are written, and is prepared before comparing it with the measurement table.

After step 14, in each luminance level section determined, new liquid crystal driving voltages are produced to be increased or decreased every the first and second fields centering around the liquid crystal voltage related to the lowest luminance level (step 16). The new liquid crystal driving voltages are obtained with satisfying the following equation according to the present invention:

$$|vx - vy| < V_threshold \tag{2}$$

wherein vy denotes AC components of the new liquid crystal driving voltage with regard to the first field, i.e., a difference between the new liquid crystal driving voltage and a reference voltage Vcom, which is a DC component. vx denotes AC components of the new liquid crystal driving voltage with regard to the second field, and V_threshold denotes a voltage critical value allowed in the liquid crystal display panel 46.

According to the present invention, it is possible to produce a new liquid crystal driving voltage in a limited range, using a measurement table showing the relationship between luminance levels measured and liquid crystal driving voltages, and the condition shown in the following equation (step 16):

$$y0<\text{new_}y<y1 \quad (3)$$

wherein y0 and y1 denote the highest and lowest luminance levels, respectively in each luminance level section, and new_y denotes a new luminance level.

Step 16 may be performed by the liquid crystal driving voltage generator 48. In other words, the liquid crystal driving voltage generator 48 produces new liquid crystal driving voltages to be increased or decreased centering around the liquid crystal driving voltage related to the lowest luminance level per first and second fields in each luminance level section determined, satisfying the condition of the equation 2. Otherwise, the liquid crystal driving voltage generator 48 produces new liquid crystal driving voltages in a limited range in accordance with the measurement table, satisfying the condition of the equation 3.

After step 16, new luminance levels are obtained using the produced new liquid crystal driving voltages (step 18). For performing step 18, according to a preferred embodiment of the present invention, the new luminance levels new_y are obtained by the following equation, using the new liquid crystal driving voltages:

$$\text{new_}y=yy*tf_1+yx*tf_2 \quad (4)$$

wherein yy=G(vy) and yx=G(vx). Here, G( ) is a function showing the characteristics of a luminance level yy or yx with regard to a new liquid crystal driving voltage, and may be expressed by the following equation 5 or measured experimentally, and tf_1 and tf_2 denote the first and second field periodic rates, respectively. The first and second field periodic rates indicate values obtained by dividing the periods 72 and 74 of the first and second fields illustrated in FIG. 3 by the frame period 70.

$$G(vy)=vy^{1/y} \quad (5)$$

wherein γ is 2.2–2.6 in the case of a cathode-ray tube (CRT), but its value varies according to the kind of liquid crystal used in the case of a liquid crystal display (LCD).

From the following Table 2, it is noted that the luminance level of an image displayed on the liquid crystal display panel 46 in a unit frame at which time a person recognizes the luminance of the image displayed on the liquid crystal panel 46 is yy/2+yx/2, assuming that liquid crystal driving voltage for an arbitrary pixel is expressed with two different AC components vx and vy on the basis of center voltage Vcom in two fields which constitute a frame, i.e., first and second fields; the first and second period rates are 1/2; the luminance levels of the first and second fields are expressed with yy and yx, respectively.

TABLE 2

| | Liquid crystal driving voltage | luminance level | periodic rate |
|---|---|---|---|
| first field | Vcom + vy | yy | 1/2 |
| second field | Vcom − vx | yx | 1/2 |

Therefore, it is concluded that a new luminance level new_y is obtained by driving the liquid crystal display panel 46 with different liquid crystal driving voltages in two consecutive fields.

An image display apparatus according to a preferred embodiment of the present invention may further include the luminance level calculator 50 of FIG. 2 for performing step 18. The luminance level calculator 50 generates new luminance levels from new liquid crystal driving voltages input from the liquid crystal driving voltage generator 48, using the equation 4, and outputs the generated new luminance levels.

In step 18 according to another embodiment of the present invention, the luminance level of an image displayed on the liquid crystal display panel 46, which is driven by a liquid crystal driving signal generated by the liquid crystal driving unit 44 in response to the new liquid crystal driving voltages, can be determined to be a new luminance level. That is, it is possible to obtain a new luminance level without the luminance level calculator 50 shown in FIG. 2. In detail, in an image display apparatus according to the present invention, the first and second storage units 40 and 42 updates liquid crystal driving voltage stored therein with the new liquid crystal driving voltages produced in step 16. Then, the liquid crystal driving unit 44 outputs a liquid crystal driving signal to the liquid crystal display panel 46 in response to the updated new liquid crystal driving voltage. At this time, the liquid crystal display panel 46 displays an image in response to the liquid crystal driving signal, and then, the liquid crystal driving voltage generator 48 measures the luminance level of the image displayed on the liquid crystal display panel 46 as a new luminance level.

In detail, for easily understanding steps 16 and 18, assuming that a luminance level section is determined in step 14 to be y0–y1, as shown in FIG. 4, a new liquid crystal driving voltage vy is produced to be increased centering around a liquid crystal driving voltage v0 related to the lowest luminance level y0 in a first field of the luminance level section y0–y1, and a new liquid crystal driving voltage vx is produced to be decreased centering around the liquid crystal driving voltage v0 in the second field of the luminance level section y0–y1 as shown in Table 3 (step 16).

TABLE 3

| number | vy | vx | new luminance level |
|---|---|---|---|
| lower base | v0 | v0 | y0 |
| 1 | v1 | vm1 | new_y1 |
| 2 | v1 | v0 | new_y2 |
| 3 | v2 | vm2 | new_y3 |
| 4 | v2 | vm1 | new_y4 |
| 5 | v3 | vm3 | new_y5 |
| 6 | v3 | vm2 | new_y6 |
| 7 | v4 | vm4 | new_y7 |
| 8 | v4 | vm3 | new_y8 |
| 9 | v5 | vm5 | new_y9 |
| 10 | v5 | vm4 | new_y10 |
| 11 | v6 | vm6 | new_y11 |
| 12 | v6 | vm5 | new_y12 |
| 13 | v6 | vm4 | new_y13 |
| 14 | v7 | vm7 | new_y14 |
| 15 | v7 | vm6 | new_y15 |
| 16 | v8 | vn9 | new_y16 |
| 17 | v8 | vm8 | new_y17 |
| 18 | v8 | vm7 | new_y18 |
| 19 | v9 | vm10 | new_y19 |
| 20 | v9 | vm9 | new_y20 |
| 21 | v10 | vm10 | new_y21 |
| . | . | . | . |
| . | . | . | . |
| . | . | . | . |
| N | vP | vmP | new_yN |
| upper base | v1 | v1 | y1 |

Here, v1 denotes a liquid crystal driving voltage related to the highest luminance level y1, and N denotes the number of gradations in each luminance level section.

Meanwhile, new liquid crystal driving voltages vy and vx can be produced as shown in the Table 4 when N is 4, and as shown in the Table 5 when N is 2.

TABLE 4

| N | lower base | 1 | 2 | 3 | 4 |
|---|---|---|---|---|---|
| vy | v0 | vm1 | v0 | vm2 | vm1 |
| vx | v0 | v1 | v1 | v2 | v2 |

TABLE 5

| N | lower base | 1 | 2 |
|---|---|---|---|
| vy | v0 | vm1 | v0 |
| vx | v0 | v1 | v1 |

As described above, after step 16, the new luminance level new_yi is obtained using the new liquid crystal driving voltages vy and vx as shown in Table 3, wherein i denotes an index of gradation (step 18).

Figure 5:
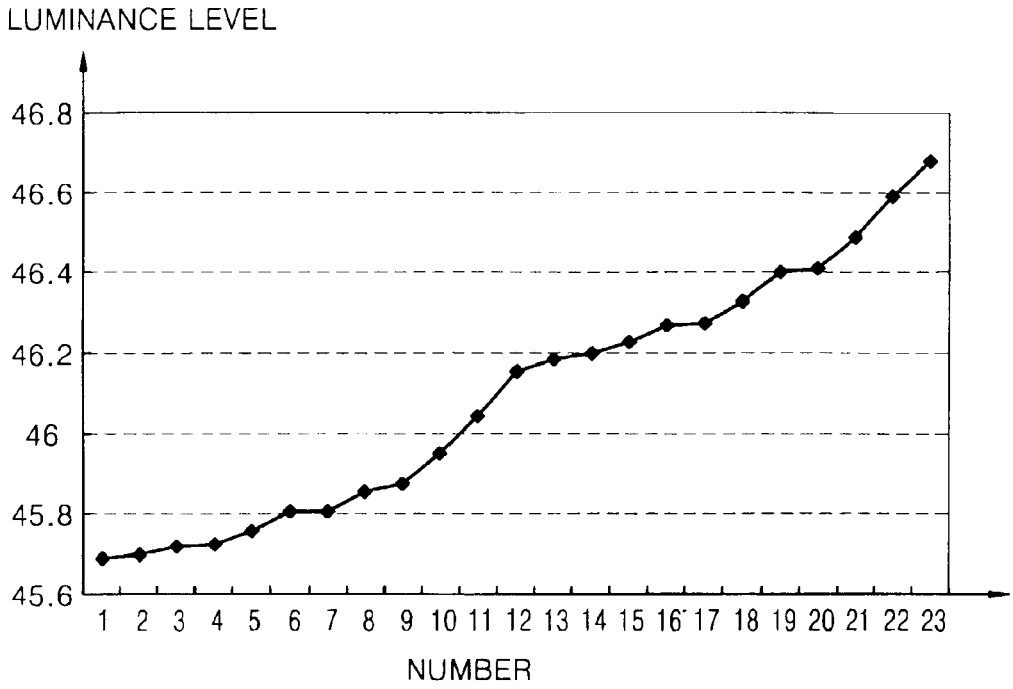
FIG. 5 is a graph exemplarily illustrating the relationship between the number of gradations and new luminance levels in ascending order.

FIG. 5 is a graph exemplarily illustrating the relationship between the number of gradations and a new luminance level, aligned in ascending order. Here, the x-axis and y-axis of the graph denote the number of gradations and the new luminance level, respectively.

For instance, the new liquid crystal driving voltages vy and vx, and a new luminance level new_y illustrated in Table 3 can be as shown in the following table 6 and FIG. 5, assuming that the new luminance level is obtained by the luminance level calculator 50, γ of G( ) is 3.2, the number N of gradations is 21, the number of different sizes an image signal can have is $2^8$, v0=149, v1=150, y0=45.688, and y1=46.677.

TABLE 6

| number | vy | Vx | new_y |
|---|---|---|---|
| lower base | 149 | 149 | 45.69 |
| 1 | 150 | 148 | 45.70 |
| 2 | 150 | 149 | 46.18 |
| 3 | 151 | 147 | 45.72 |
| 4 | 152 | 148 | 46.20 |
| 5 | 153 | 146 | 45.75 |
| 6 | 153 | 147 | 46.23 |
| 7 | 154 | 145 | 45.80 |
| 8 | 154 | 146 | 46.27 |
| 9 | 155 | 144 | 45.87 |
| 10 | 155 | 145 | 46.33 |
| 11 | 156 | 143 | 45.95 |
| 12 | 156 | 144 | 46.40 |
| 13 | 156 | 145 | 45.80 |
| 14 | 157 | 142 | 46.04 |
| 15 | 157 | 143 | 46.49 |
| 16 | 158 | 140 | 45.72 |
| 17 | 158 | 141 | 46.15 |
| 18 | 158 | 142 | 46.59 |
| 19 | 159 | 139 | 45.85 |
| 20 | 159 | 140 | 46.28 |
| 21 | 160 | 139 | 46.41 |
| upper base | 160 | 150 | 46.68 |

After step 18, at least first available luminance level is selected from the new luminance levels (step 20). For performing step 20 according to a preferred embodiment of the present invention, a new luminance level new_$y_1$ of an ith gradation satisfying the aforementioned equation 3 and the following equation 6 may be determined to be a first luminance level:

$$\frac{\left|\text{new_y}_i - \sum_{k=1}^{M} \text{new_y}_k\right|}{\text{new_y}_i} > \text{y_delta},\ (i \neq k) \tag{6}$$

wherein M denotes the number of first luminance levels, in advance determined to be available.

For performing step 20 according to another embodiment of the present invention, a new luminance level new_$y_1$ or y of an ith gradation that satisfies the following equation 7 as well as the aforementioned equations 3 and 6 may be determined as a first luminance level:

$$|y-yx|<B(y,f) \tag{7}$$

wherein f denotes the frequency of a frame, and B(,) denotes a function dependent on y and f. When the first luminance level does not satisfy the condition of the equation 7, flicker may occur. At this time, B(,) indicates the threshold value of a difference between luminance levels of two fields a user can perceive at a predetermined position on the liquid crystal display panel 46, and may vary according to the physical characteristics of liquid crystal. According to the present invention, with the frequency f fixed, B(,) can be illustrated in the form of a table while changing the new luminance level, or one value corresponding to B(,) can be measured experimentally.

After step 20, it is checked whether the gradations of an image is improved by at least one luminance level (step 22). If it is determined that the gradations of the image is not improved, the procedure returns back to step 20. In other words, when step 12 is included in a method of improving the gradations of an image according to the present invention, it is determined that the gradations of the image is improved if the number of the gradations is increased by at least one first luminance level, and a difference between luminance levels of the gradations is regular. However, if the difference between the luminance levels is still irregular, the gradations of the image are considered as not being improved.

When the gradations of the image is determined to not be improved, y_delta is reduced, and at least one first luminance level is again selected from the new luminance levels using the reduced y_delta, in step 20.

When step 12 is included in another embodiment of the present invention, i.e., there is a need to solve for the irregularity of the luminance levels although the number of the gradations is not insufficient, the number N of the gradations can be determined in step 20, rather than in step 14. In this case, the greater the number of the gradations is set, the smaller the value of T or y_delta is set, and the smaller the number of the gradations is, the greater the value of T is set.

For steps 20 and 22, the controller 52 of FIG. 2 may be included in an image display apparatus according to the present invention. Here, the controller 52 selects at least one first luminance level from the new luminance levels which are generated by the luminance level calculator 50, as shown in FIG. 2, or generated by the liquid crystal driving voltage generator 48 unlike shown in FIG. 2, as described above. Then, the controller 52 checks whether the gradations of the image are improved using the selected first luminance level, and/or again selects the first luminance level in response to the checked result.

Hereinafter, in the event that a difference between the luminance levels of adjacent gradations is irregular although the number of gradations is not scant and the number of different sizes an image signal can have is 8 bits, i.e., 256 values, a method for improving the gradations of an image, according to the present invention, will be described.

Figure 6:
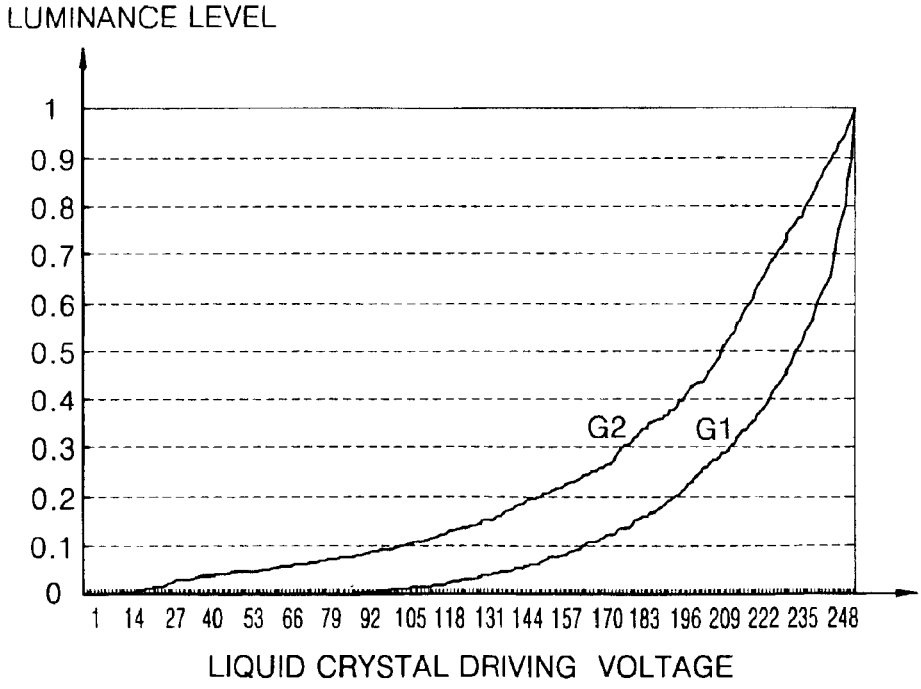
FIG. 6 is a graph illustrating the relationship between AC components of liquid crystal driving voltage and normalized luminance levels for explaining a method of improving the gradation of an image according to the present invention.

Referring to FIG. 6, the y-axis and x-axis of a graph denote normalized luminance levels, and AC components of liquid crystal driving voltage, respectively.

First, the size of luminance levels is measured while changing the size of liquid crystal driving voltage from 0 to 255 per frame (step 10). At this time, the relationship G1 between the measured luminance level and AC components of liquid crystal driving voltage is as illustrated in FIG. 6. After step 10, only second luminance levels, which satisfy the aforementioned equation 1, are extracted from normalized luminance levels 0–1 (step 12). After step 12, a luminance level section that satisfies the equation 1 and in which the slope which is a change in the luminance levels of images displayed on the liquid crystal display panel 46 toward a change in liquid crystal driving voltage is steep, is determined (step 14). For instance, the range of the liquid crystal driving voltage, which corresponds to the luminance level section determined in step 14, may be from 180 to 255. After step 14, new liquid crystal driving voltage is produced per field as illustrated in table 4 (step 16). After step 16, a new luminance level of an image is measured directly from the liquid crystal display panel 46 or obtained using equation 4 (step 18). After step 18, a first luminance level satisfying equations 3 and 6, or equations 3, 6 and 7 is selected (step 20). At this time, the selected first luminance levels are inserted to a section in which a difference between luminance levels of gradations is irregular, and then, it is checked if gradations of the image are improved (step 22). If the gradations are not improved, the value of y_delta shown in equation 6 is reduced, and then, first luminance level is again selected (step 20). If it is determined that the gradations are improved, it is possible to find out the relationship G2 between the new luminance level, and the liquid crystal driving voltages except for a center voltage Vcom, as shown in FIG. 6.

An analysis of the characteristics of gradations of an image illustrated in graphs G1 and G2 of FIG. 6 using the condition of equation 6 reveals the number N of the gradations with regard to T as shown in Table 7, assuming that A is 255.

TABLE 7

| | G1 | | | | G2 | | | |
|---|---|---|---|---|---|---|---|---|
| T | 0.5 | 0.3 | 0.2 | 0.1 | 0.5 | 0.3 | 0.2 | 0.1 |
| N | 186 | 187 | 190 | 192 | 247 | 254 | 254 | 255 |

The image display apparatus of FIG. 2 is just an example of apparatuses for performing a method of improving gradations of an image, according to the present invention, illustrated in FIG. 1. Therefore, the method of FIG. 1 is not limited by the structure and operations of the image display apparatus of FIG. 2.

While the present invention has been particularly shown and described with reference to a preferred embodiment thereof, it will be understood by those skilled in the art that various changes in form and details may be made therein without departing from the spirit and scope of the invention as defined by the appended claims.

As described above, using a method of improving gradations of an image and an image display apparatus therefor according to the present invention, it is possible to increase the number of gradations of an image, preventing the aforementioned problems caused by the prior art. Also, irregular difference between luminance levels of gradations can be amended to be regular. Further, this method and apparatus can be applied in amending the tone of an image in order to express substantially the gradations, thereby obtaining good quality of an image.

What is claimed is:

1. A method of improving gradations of an image carried out by a liquid crystal display including a liquid crystal driving unit for generating a liquid crystal driving signal in response to voltage, which is selected in accordance with the size of an image signal from liquid crystal driving voltages each classified by first and second fields which constitutes a unit frame, and a liquid crystal display panel for being driven in response to the liquid crystal driving signal and displaying the image, the method comprising steps of:

(a) measuring luminance levels of an image displayed on the liquid crystal display panel while changing the liquid crystal driving voltage per frame;

(b) determining at least one luminance level section whose gradations needs to be improved from the measured luminance levels;

(c) producing new liquid crystal driving voltages to be increased or decreased centering around the liquid crystal driving voltage related to lowest luminance level per the first and second fields in each determined luminance level section;

(d) obtaining new luminance levels using the produced new liquid crystal driving voltages;

(e) selecting at least one available first luminance level from the new luminance levels; and (f) checking whether the gradations of the image are improved using the first luminance level, and/or returning back to step (e) if the gradations are not improved.

2. The method of claim 1 further comprising step of (g) extracting second available luminance levels using a difference between luminance levels of adjacent gradations from the measured luminance levels after step (a), and then performing step (b), wherein in step (b), the luminance level section is selected from the second luminance levels after step (g).

3. The method of claim 2, wherein step (g) comprises determining the luminance levels y_a and y_b of the adjacent gradations, which satisfy the following formula, as the second luminance levels:

$$\frac{|y_a - y_b|}{y_a} > y_delta,$$

wherein y_delta denotes T/A, A denotes the number of different luminance levels pixel of the image displayed can have, and T denotes an allowable tolerance factor that is smaller than 1.

4. The method of claim 3, wherein in step (b), the number of gradations of each luminance level section determined is determined.

5. The method of claim 4, wherein in step (b) a reference table and a measurement table are compared with each other, and the number of the gradations is determined using the comparison result, and the measurement table is a table to which the luminance levels measured, and the liquid crystal driving voltages changed per frame in step (a) are written, and the reference table is a table to which the liquid crystal driving voltages and reference luminance levels were written in advance.

6. The method of claim 2, wherein in step (e) the number of the gradations in each luminance level determined is determined.

7. The method of claim 2, wherein the new liquid crystal driving voltages produced in step (c) satisfies the formula:

$$|vx-vy|<V_threshold,$$

wherein vx and vy denote AC components of the new liquid crystal driving voltages for the first and second fields, and V_threshold denotes a voltage critical value that the liquid crystal display panel permits.

8. The method of claim 7, wherein in step (c) the new liquid crystal driving voltage is produced in a limited range using the relationship between the luminance levels measured in step (a) and the liquid crystal driving voltages, and the formula:

$$y0<new_y<y1,$$

wherein y0 and y1 denote the lowest and highest luminance levels in each luminance level section, and new_y denotes the new luminance level.

9. The method of claim 1, wherein in step (d) the new luminance levels new_y are obtained using the new liquid crystal driving voltages as follows:

$$new_y=yy*tf_1+yx*tf_2,$$

wherein yy=G(vy), yx=G(vx), vy and vx denote AC components of the new liquid crystal driving voltages for the first and second fields, G( ) denotes a gamma function varying according to the type of liquid crystal used in the image display apparatus, and tf_1 and tf_2 denote periodic rates of the first and second fields.

10. The method of claim 1, wherein in step (d) the luminance level of the image displayed on the liquid crystal display panel driven by the liquid crystal driving signal generated in response to the new liquid crystal driving voltages, is determined as the new luminance level.

11. The method of claim 1, wherein in step (e) the new luminance level new_y, of an ith gradation, which satisfies the following formula, is determined as the first luminance level:

$$y0 < new_y_i < y1 \text{ and } \frac{\left| new_y_i - \sum_{k=1}^{M} new_y_k \right|}{new_y_i} > y_delta,\ (i \neq k),$$

wherein y0 and y1 denote the lowest and highest luminance levels in each luminance level section, respectively, M denotes the number of the first luminance levels which is determined in advance, y_delta denotes T/A, A denotes the number of different luminance levels the pixel of the image displayed can have, and T denotes an allowable tolerance factor that is smaller than 1.

12. The method of claim 11, wherein in step (e) if it is determined that the gradations of the image are not improved, y_delta is reduced, and the first luminance level is again selected from the new luminance levels, using the reduced y_delta.

13. The method of claim 11, wherein in step (e) the new luminance level y, which further satisfies the following formula, is determined as the first luminance level:

$$|yy-yx|<B(y,f),$$

wherein yy=G(yy), yx=G(vx), vy and vx denote AC components of the new liquid crystal driving voltages for the first and second fields, G( ) denotes a gamma function changing according to the type of liquid crystal used in the image display apparatus, f denotes the frequency of the frame, and B(,) denotes a function depending on y and f.

14. A liquid crystal display for performing the method of improving gradations of an image as claimed in claim 1, the liquid crystal display comprising:

a first storage unit for reading out voltage corresponding to the size of the image signal from the liquid crystal driving voltages stored with respect to the first field, in response to a first control signal;

a second storage unit for reading out voltage corresponding to the size of the image signal from the liquid crystal driving voltages stored with respect to the second field, in response to a second control signal;

a liquid crystal driving unit for generating a liquid crystal driving signal in response to the liquid crystal driving voltage read out by the first or second storage unit;

a liquid crystal driving voltage generator for measuring the luminance levels of the image displayed on the liquid crystal display panel, and for generating the new liquid crystal driving voltages classified by the first and second fields in each luminance level section extracted from the measured luminance levels; and a controller for alternately generating one of the first and second control signals in the unit of field, selecting at least available first luminance level from the new luminance levels, checking whether gradations of the image is improved based on the selected first luminance level, and again selecting the first luminance level in response to the checked result, wherein the first and second storage units updates the stored liquid crystal driving voltage with the new liquid crystal driving voltage generated by the liquid crystal driving voltage generator.

15. The liquid crystal display of claim 14, wherein the liquid crystal driving voltage generator extracts only available second luminance levels from the measured luminance levels using a difference between the luminance levels of adjacent gradations, and determines the luminance level section from the second luminance levels.

16. The liquid crystal display of claim 14 further comprising a luminance level generator for generating the new luminance levels from the new liquid crystal driving voltages generated by the liquid crystal driving voltage generator, and for outputting the generated new luminance levels to the controller.

17. The liquid crystal display of claim 14, wherein the liquid crystal driving voltage generator measures the luminance level of the image displayed on the liquid crystal display panel in response to the new liquid crystal driving voltage as the new luminance level, and outputs the measured new luminance level of the image to the controller.

* * * * *